United States Patent [19]

Ollinger et al.

[11] Patent Number: 4,893,444

[45] Date of Patent: Jan. 16, 1990

[54] FIRE EXPANSION JOINT FOR CEILING RUNNER

[75] Inventors: James C. Ollinger, Lancaster; Daniel C. Ziegler, Millersville, both of Pa.

[73] Assignee: Armstrong World Industries, Inc., Lancaster, Pa.

[21] Appl. No.: 189,188

[22] Filed: May 2, 1988

[51] Int. Cl.[4] ..... E04C 2/42; E04B 5/50

[52] U.S. Cl. ..... 52/232; 52/484; 52/573; 52/729; 52/DIG. 5

[58] Field of Search ..... 52/DIG. 5, 573, 232, 52/484, 729

[56] References Cited

U.S. PATENT DOCUMENTS

| | | | |
|---|---|---|---|
| 3,175,655 | 3/1965 | Brown | 52/DIG. 5 |
| 3,388,519 | 6/1968 | Downing | 52/232 |
| 3,589,089 | 6/1971 | Kedel | 52/DIG. 5 |
| 3,807,111 | 4/1974 | Brady | 52/DIG. 5 |
| 3,846,031 | 11/1974 | Adams | 52/DIG. 5 |
| 4,016,701 | 4/1977 | Beynon | 52/DIG. 5 |
| 4,601,153 | 7/1986 | Dunn | 52/232 |
| 4,606,166 | 8/1986 | Platt | 52/573 |
| 4,685,262 | 8/1987 | Meredith | 52/232 |
| 4,785,895 | 11/1988 | Dunn | 52/DIG. 5 |

*Primary Examiner*—John E. Murtagh

[57] ABSTRACT

The expansion joint for the runner is formed with two cut-out areas and cuts in the vertical web to permit the horizontal web, enlarged bulb and remaining web by the cut-out areas to bend outward to absorb expansion of the runner when subjected to fire.

4 Claims, 1 Drawing Sheet

FIRE EXPANSION JOINT FOR CEILING RUNNER

BACKGROUND OF THE INVENTION

1. Field of the Invention

The invention is directed to a ceiling runner and, more particularly, to a ceiling runner with a fire expansion joint.

2. Description of the Prior Art

U.S. Pat. No. 3,589,089 discloses a ceiling runner having two openings in the vertical web to absorb expansion of the ceiling runner when mounted in a suspended ceiling system. The openings permit the flanges of the ceiling runner to bend downward, the enlarged bulb at the top of the ceiling runner to bend upward and the two pieces of metal forming the web of the ceiling runner to expand outwardly to either side of the web of the ceiling runner.

SUMMARY OF THE INVENTION

An expansion runner for a ceiling system is composed of a vertical web member with upper and lower ends. The vertical web manner has an enlarged bulb at its upper end and horizontal flange extending from both sides of the lower end of the vertical web. The runner has an upper elongated opening adjacent to the upper end of the web and the runner has a lower elongated opening positioned in the vertical web intermediate the upper and lower ends of the vertical web. The upper and lower openings have a length taken along the length of the runner to accommodate anticipated expansion of the runner upon exposure to fire whereby the expansion joint of the runner absorbs the anticipated expansion of the runner.

The improvement herein involves the extending of the upper elongated opening from the upper end of the web into the enlarged bulb. The upper elongated opening has upper and lower edges and the upper edge has only one triangular notch cut therein with the notch positioned at the midpoint of the upper edge and the notch extends almost to the top of the enlarged bulb. At each end of the upper edge of the upper opening, a straight line cut with abutting edges extends from the upper opening towards and to almost the top of the enlarged bulb. The lower elongated opening has upper and lower margins and the upper margin is spaced from the lower edge of the upper elongated opening. The lower margin has only one triangular notch wherein with the notch positioned at the midpoint of the lower margin and extending to adjacent the horizontal flange. At each end of the lower margin, a straight line cut with abutting edges extends from the lower opening toward and to almost the top of the horizontal flange.

The lower edge of the upper opening has a short straight line indentation at each of the lower edge and the straight line indentations extend towards the lower opening.

A portion of the vertical web remains between the upper and lower openings and this portion of the vertical web is positioned above any ceiling board resting on the horizontal flange of the vertical web whereby movement of said portion of the web away from the plane of the web will not cause said portion of the web to press on or dislodge the board from the runner.

Finally, the enlarged bulb is thicker than the vertical web member and the lower edge of the upper opening has flared flanges that are part of the enlarged bulb which is cutaway to form the upper opening.

DETAILED DESCRIPTION OF THE PREFERRED EMBODIMENT

Figure 1:
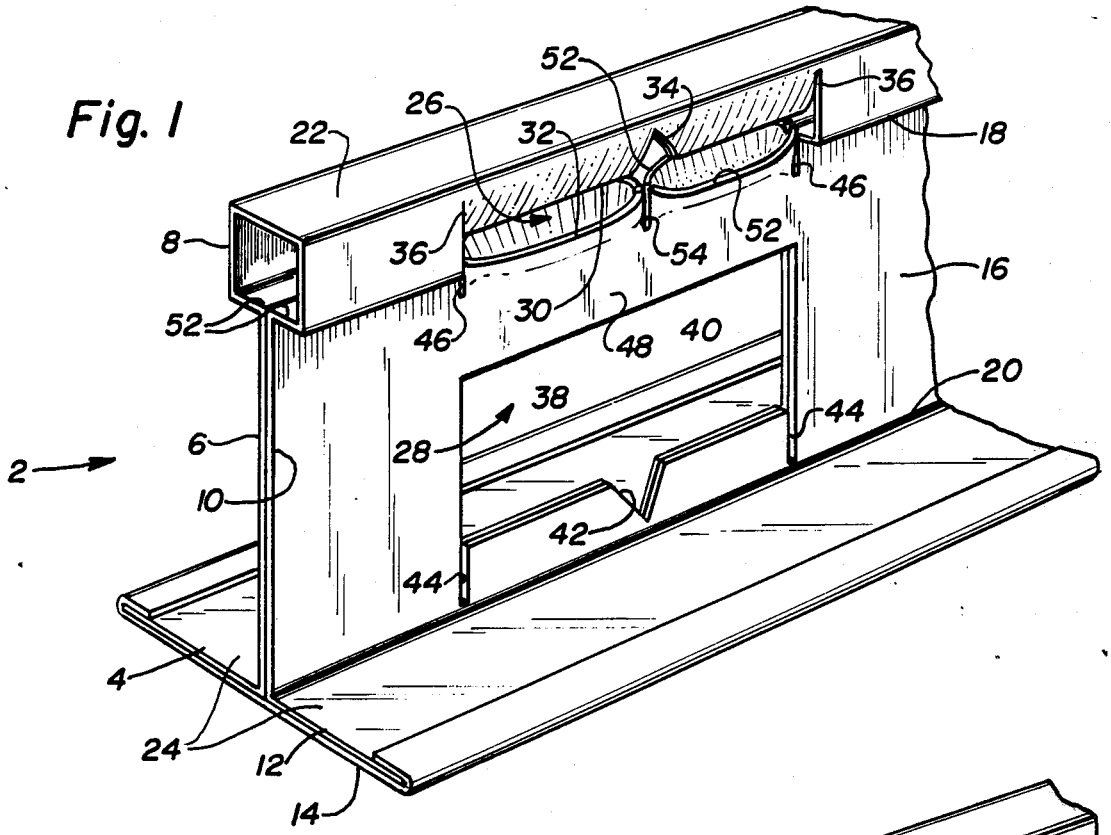
FIG. 1 is a perspective view of the invention herein.
Figure 2:
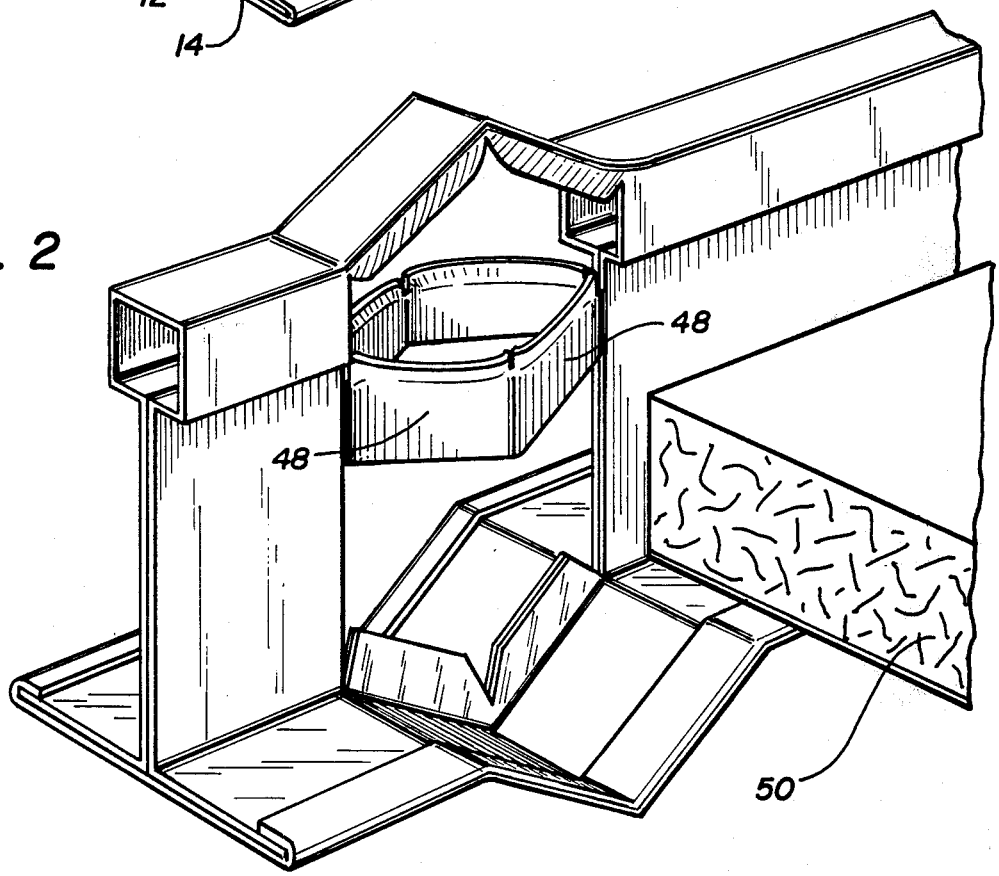
FIG. 2 is a perspective view of the invention herein after it has been caused to function as an expansion joint.

The invention herein is an expansion runner 2 for a ceiling system. The expansion runner is formed of a single piece of metal for its basic structure. The metal starts with element 4 which is bent at a 90° angle to form element 6. At the top of element 6, the sheet metal forming the runner is bent into an enlarged open section 8 and then element 10 is placed side by side with element 6 and finally, element 12 is bent at a right angle to element 10. This forms an inverted T structure. Element 14 is then placed underneath of elements 4 and 12 and wrapped around the edges of elements 4 and 12 to hold the elements 6 and 10 in an abutting relationship. There is thus formed a vertical web member 16 with an upper end 18 and a lower end 20. The vertical web member has an enlarged bulb 22 at its upper end and a horizontal flange 24 extending from both sides of its lower end 20. The runner has an upper elongated opening 26 adjacent the upper end of the web and the runner has a lower elongated opening 28 positioned in the vertical web 16 intermediate the upper 18 and lower 20 ends of the vertical web. The upper and lower openings 26 and 28 have a length taking along the length of the runner selected to accommodate anticipated axial expansion of the runner upon exposure to a fire. FIG. 1 is a showing of the runner structure before it has been subjected to expansion forces as a result of a fire and FIG. 2 is a showing of a runner structure that has been subjected to expansion forces as result of a fire and the expansion forces are absorbed in the region of the two elongated openings. In this way, during a fire, the ends of the runner will not press against adjacent runners or the walls and enlarge the opening in the grid work and cause a ceiling board to drop out of the suspended ceiling.

The improvement herein involves the specific structure of the two elongated openings. The upper elongated opening 26 extends from the upper end 18 of the web 16 into the enlarged bulb 22. The upper elongated opening has an upper edge 30 and a lower edge 32. The upper edge has only one triangular notch 34 therein with the notch positioned at the midpoint of the upper edge and extending to almost the top of the enlarged bulb. At each end of the upper edge, a straight line cut 36 with abutting edges extends from the upper opening toward and to almost the top of the enlarged bulb. The lower elongated opening 28 has an upper margin 38 and a lower margin 40. The upper margin 38 is spaced from the lower edge 32 of the upper elongated opening 26. The lower margin 40 has only one triangular notch 42 therein with the notch positioned at the midpoint of the lower margin and extending to adjacent the horizontal flange 24. At each end of the lower margin 40, a straight line cut 44 with abutting edges extends from the lower opening toward and to almost the top of the horizontal flange 24.

The portion 48 of the vertical web remaining between the upper and lower openings is positioned above any ceiling board 50 (see FIG. 2) resting on the horizontal flange of the vertical web whereby movement of said portion 48 of the web away from the plane of the web as shown in FIG. 2 will not cause said portion 48 of the web to press on or dislodge the board 50 from the runner.

As best seen in FIG. 1, the enlarged bulb is thicker than the vertical web member and the lower edge 32 of the upper opening 26 has flared flanges 52 that are part of the enlarged bulb which is cutaway to form the upper opening. As can be seen from the end of the structure of FIG. 1, elements 6 and 10 form the vertical web. At the top of the vertical web, elements 6 and 10 flare out to form the bottom of the enlarged bulb 8. The lower edge of the upper opening is cut so that the flared out elements actually form part of the lower edge of the upper opening. The lower edge of the upper opening 26 has a short straight line indentation or cut 46 at each end of the lower edge 32 with the straight line cut of indentation 46 extending toward the lower opening. A cut or indentation 54 is placed in the lower edge of the upper opening below notch 34 to weaken the metal at that point and to cause the flared edge 52 to be positioned adjacent each other at that point. Elements 46 & 54 can be an actual cut in the metal, but it is preferred that the metal at the flared edges 52 be indentations, i.e. the metal is not cut, but the flared edges are indented and pressed together. This is necessary to permit proper bending of the portion 48 to absorb expansion of the runner metal. However, the flared edges 52 are there to provide strength to the portion 48 when it is in its normal position providing support for a ceiling board.

When the expansion joint absorbs the expansion of the runner during a fire, the flanges 24 bend by the notch 42 and move downward as shown in FIG. 2. Because of the cuts 44, the downward movement of the horizontal flanges 24 is not restrained. Likewise, the enlarged bulb 22 will bend upward due to the existence of the notch 26 and this upward movement is not restrained because of the cuts 36 which permit the enlarged bulb to move upward. The two pieces of metal forming the portion 48, due to the cuts or indents 46 and 54 will now expand outwardly from the plane of the web 16 normally with one piece of metal extending to one side of the web and the other piece of metal extending to the other side of the web as shown in FIG. 2. Consequently, the expansion of the runner during a fire test is absorbed in the expanding expansion joint which is shown in its expanded state in FIG. 2. The cuts 44 and 46 have abutting edges. The term "abut" as defined in Webster's Unabridged Dictionary, 2nd Edition, 1979, means "to meet", and "to be contiguous". "Contiguous" means "close together", "neighboring" or "adjoining". Consequently, to abut means to touch or to adjoin wherein the cut edges are in contact or in proximity.

What is claimed is:

1. An expansion runner for a ceiling system comprising:

(a) a vertical web member with upper and lower ends;

(b) said vertical web member having an enlarged bulb at its upper end and a horizontal flange extending from both sides of its lower end;

(c) said runner having an upper elongated opening adjacent the upper end of the web and, said runner having a lower elongated opening positioned in the vertical web intermediate the upper and lower ends of the vertical web;

(d) the upper and lower openings having a length taken along the length of the runner selected to accommodate anticiapted axial expansion of the runner upon exposure to a fire;

(e) the improvement comprising:

(1) said upper elongated opening extends from the upper end of the web into the enlarged bulb, the upper elongated opening having upper and lower edges, said upper edge having only one triangular notch therein with the notch positioned at the midpoint of the upper edge and extending to almost the top of the enlarged bulb, at each end of the upper edge a straight line cut with abutting edges extends from the upper opening toward and to almost the top of the enlarged bulb, and (2) said lower elongated opening having upper and lower margins, said upper margin being spaced from the lower edge of the upper elongated opening, said lower margin having only one triangular notch therein with the notch positioned at the midpoint of the lower margin and extending to adjacent the horizontal flange, at each end of the lower margin a straight line cut with abutting edges extends from the lower opening toward and to almost the top of the horizontal flange.

2. The expansion runner for a ceiling system as set forth in claim 1 wherein:

(a) the lower edge of the upper opening has a short straight line indent at each end of the lower edge, said straight line indents extend toward the lower opening.

3. The expansion runner for a ceiling system as set forth in claim 2 wherein:

(a) a portion of the vertical web remains between the upper and lower openings, this portion of the vertical web is positioned above any ceiling board resting on the horizontal flange of the vertical web whereby movement of said portion of the web away from the plane of the web will not cause said portion of the web to press on or dislodge the board from the runner.

4. The expansion runner for a ceiling system as set forth in claim 3, wherein:

(a) the enlarged bulb is thicker than the vertical web member, and (b) the lower edge of the opening has flared flanges that are a part of the enlarged bulb which is cut away to form the upper opening.

* * * * *